US006318470B1

(12) United States Patent
Chang et al.

(10) Patent No.: US 6,318,470 B1
(45) Date of Patent: Nov. 20, 2001

(54) RECIRCULATABLE BALL-DROP RELEASE DEVICE FOR LATERAL OILWELL DRILLING APPLICATIONS

(75) Inventors: Chi-Huang Michael Chang, Sugar Land; James W. Estep, Houston; Albert C. Odell, II, Kingwood, all of TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/504,569

(22) Filed: Feb. 15, 2000

(51) Int. Cl.[7] ..... E21B 23/00
(52) U.S. Cl. ..... 166/377; 166/318; 175/62
(58) Field of Search ..... 166/377, 318, 166/386, 50; 175/62

(56) References Cited

U.S. PATENT DOCUMENTS

| | | | |
|---|---|---|---|
| 5,146,984 | 9/1992 | Pleasants | 166/238 |
| 5,219,027 | 6/1993 | Taylor | 166/377 |
| 5,323,853 | 6/1994 | Leismer et al. | 166/55 |
| 5,337,829 | 8/1994 | Taylor | 166/377 |
| 5,366,010 | 11/1994 | Zwart | 166/120 |
| 5,394,951 | 3/1995 | Pringle et al. | 175/61 |
| 5,411,085 | 5/1995 | Moore et al. | 166/242 |
| 5,419,399 | 5/1995 | Smith | 166/377 |
| 5,505,261 | 4/1996 | Huber et al. | 166/297 |
| 5,526,888 | 6/1996 | Gazewood | 175/320 |
| 5,704,393 | 1/1998 | Connell et al. | 137/614.21 |
| 5,718,291 | 2/1998 | Lorgen et al. | 166/377 |
| 5,787,982 * | 8/1998 | Bakke | 166/242.6 |
| 5,845,711 | 12/1998 | Connell et al. | 166/384 |
| 5,960,884 * | 10/1999 | Echols | 166/317 |

* cited by examiner

*Primary Examiner*—David Bagnell
*Assistant Examiner*—Jennifer R. Dougherty
(74) *Attorney, Agent, or Firm*—Godley, Rose & Tayon, P.C.

(57) ABSTRACT

A method for disconnecting tubular members and a ball-drop release device including an upper housing connected to tubing and a lower housing connected to a bottom hole assembly. The upper housing includes a recess end having grooves, and the lower housing includes an extension end having splines that fit into the upper housing grooves. The splined connection is designed to resist drilling motor backup torque and prevent the release mechanism from locking up. In the pre-release position, a ball sleeve is disposed within the extension and held in place by shear screws. To actuate the device, a ball, preferably having a density equal to the density of the drilling fluid, is dropped into the well and pumped to engage the ball sleeve. The ball seats with the ball sleeve whether the well bore is disposed vertically, laterally, or sloped upwardly. Once the ball seats, pressure builds behind the sleeve until the shear screws shear. The ball sleeve moves into a recess in the lower housing thereby making the upper and lower housings separable. Before disconnecting the upper and lower housings, fluid flows into the well through recirculation ports on the lower end of the ball sleeve. After separating the upper and lower housings, a fishing tool can grapple the extension to retrieve the lower housing and bottom hole assembly when necessary. When the fishing tool is attached, flow can be resumed into the well through the ball sleeve recirculation ports to aid in retrieval.

25 Claims, 6 Drawing Sheets

RECIRCULATABLE BALL-DROP RELEASE DEVICE FOR LATERAL OILWELL DRILLING APPLICATIONS

CROSS-REFERENCE TO RELATED APPLICATIONS

Not Applicable.

STATEMENT REGARDING FEDERALLY SPONSORED RESEARCH OR DEVELOPMENT

Not Applicable.

FIELD OF THE INVENTION

The present invention relates generally to a well drilling apparatus release device and method for disconnecting tubular members downhole, such as, for example, disconnecting tubing from a bottom hole drilling assembly in the event the bottom hole assembly becomes stuck during downhole drilling operations. More particularly, the present invention relates to a disconnect method and release device of the ball-drop variety using a hollow ball with a density approximately equal to the drilling fluid density such that the ball can be pumped with the drilling fluid into a lateral or upwardly sloping well bore to engage and actuate the release device. Still more particularly, the present invention relates to a disconnect method and a ball-drop release device including a shiftable ball sleeve having recirculation ports through which flow can continue after the ball-drop release device has been actuated.

BACKGROUND OF THE INVENTION

Increasingly, the drilling of oil and gas wells is no longer a matter of drilling a vertically straight bore hole from the surface to the desired hydrocarbon zone. Rather, technology and techniques such as directional drilling have been developed to drill lateral or sometimes upwardly sloping well bores. It is often not economically feasible during such drilling operations to withdraw the drilling apparatus to add another discrete length of jointed drill pipe when necessary. Therefore, tools and methods have been developed for drilling bore holes using coiled tubing, which is a single length of continuous, unjointed tubing spooled onto a reel for storage in sufficient quantities to exceed the maximum length of the bore hole.

In well drilling applications, many circumstances can arise in which it is desirable to disconnect the tubing from the bottom hole assembly, such as, for example, when a bottom hole assembly gets stuck during drilling and the tubing must be disconnected from the bottom hole assembly to facilitate fishing, jarring, or other operations.

When application of a torque on the tubular members is permissible, traditional disconnection means such as threaded connections are frequently acceptable. However, when using non-rigid tubing such as coiled tubing, a torque can not be applied to disconnect the tubing from the drilling apparatus, and an axial disconnection means must be utilized. Pre-installation of an axial release device between the tubing and the bottom hole drilling assembly can provide a means to disconnect tubular members downhole if and when disconnection becomes necessary.

A variety of axial disconnect devices have been developed for use downhole, some of which use hydraulic or electrical lines that extend from the surface to actuate a piston and cause a release. One such device described in U.S. Pat. No. 5,323,853 includes redundant releasing mechanisms depending alternatively on either hydraulic or electrical actuation of a piston. The additional lines and cables run inside the well bore that are required to actuate this device have the disadvantage of creating an obstruction to fluid flow during normal drilling operations.

Another type of known release device depends for actuation on directing fluid flow so as to create backpressure and actuate a piston. U.S. Pat. No. 5,718,291 describes one such release mechanism that depends for actuation on either the use of backpressure created by flow through the device, or if flow is prevented, the use of built-up pressure within a passage in the device. In the first mode, backpressure created by flow through a restrictor above a shiftable sleeve overcomes a biasing spring to move the sleeve through a J-slot assembly until a passage is obstructed. Thereafter, pressure buildup in a second passage overcomes a shear pin, causing a piston to move and release dogs that lock two segments of the device together. If flow is prevented, pressure buildup in the second passage causes the piston to move against the shifting sleeve to overcome the force of the spring and selectively move the sleeve through the J-slot assembly. A disadvantage of this device is that aligning the sleeve properly to engage the top of the J-slot assembly is cumbersome, requiring that pressure be created and removed by turning pumps on and off from the surface.

Still another conventional release device depends for actuation on dropping a ball into a well from the surface, sealing a flow passage, and building up pressure behind the ball to cause a disconnection. One such ball-drop release device is described in U.S. Pat. No. 5,419,399 and includes a housing with a slideable piston disposed within and releasably connected to the housing by shear screws. A ball is dropped into the well from the surface to seat with the upper end of the piston and block the flow passage, thereby creating pressure on a mandrel of the piston sufficient to overcome the shear screws. The mandrel moves downward such that keys align to fit into annular grooves on the mandrel to disengage notches, allowing the tubing to be disconnected from the drilling apparatus. A disadvantage of this device is that the operator must pull back or agitate the device to cause the keys to drop into the grooves should they fail to do so.

A further ball-drop release device is described in U.S. Pat. No. 5,526,888 and includes an upper and lower housing insertably connected and locked together by latch blocks, a slotted piston that operates the latch blocks, a pilot piston, and a lock-out mechanism operated by movement of the pilot piston. A sealing ball is dropped into the well and seats with the pilot piston to create a pressure differential sufficient to overcome shear pins, thereby allowing the pilot piston to axially shift downward. Movement of the pilot piston releases a lock-out mechanism such that the slotted piston extends axially to retract the latch blocks and thereby disconnect the upper and lower housings.

Release devices of the ball-drop variety have several advantages over other types of release devices. Namely, selective rather than inadvertent separation is ensured because the operator must drop a ball into the well bore to actuate the release mechanism. There are also no requirements for additional hydraulic cables or electrical lines to actuate the release mechanism, and there are no cumbersome alignment requirements.

However, conventional ball-drop release devices have some limitations. The release ball is typically only suited for actuating a release device in a vertically disposed well bore. The release ball commonly has a density greater than the drilling fluid density such that it drops down through the drilling fluid in a vertical well bore to land and seat on the ball sleeve, thereby sealing the flow passage. When the well bore is not vertical, it is difficult to dependably land and seat the ball on the ball sleeve, especially when the ball must climb up a chamfer in a reduced diameter section to reach the ball sleeve in a lateral or upwardly sloped well bore.

Additionally, prior ball-drop release devices prevent continued circulation of drilling fluid through the device after the release mechanism is actuated, and these devices are not designed to effectively resist drilling motor backup torque necessary to prevent the release mechanism from locking up in the event the drilling motor is installed near the release device.

The present invention overcomes the deficiencies of the prior art.

NOMENCLATURE

During the course of the following description, the terms "upper" and "lower" are used to denote the relative position of certain components with respect to the direction of flow of the incoming drilling mud. Thus, where a term is described as upper and another is described as lower, it is intended to mean that drilling mud flows first through the upper component before flowing through the lower component. Thus, these and other terms are used to identify the relative position of components in the release device with the upper components being positioned closer to the tubing and the lower components being positioned closer to the bottom hole assembly.

SUMMARY OF THE INVENTION

The present invention features a method for disconnecting tubular members downhole and a well drilling release device comprising a housing having upper and lower separable parts. The upper housing part has a first end forming a stepped recess and a second end adapted to be connected to well tubing, while the lower housing part has a first end forming a stepped extension and a second end adapted to be connected to a bottom hole assembly. The first ends of the upper and lower housing parts are connected such that the extension of the lower housing fits sealingly within the recess of the upper housing. As said first ends connect, machined splines disposed circumferentially around the lower housing extension fit within corresponding grooves disposed circumferentially within the upper housing recess. A shiftable ball sleeve with elongate recirculation ports around its lower circumference is disposed axially within the lower housing extension. In the connected and locked pre-release position, the upper and lower housing parts are engaged, and the ball sleeve is held in place relative to said upper and lower housing parts by shear screws extending radially through the upper housing part and the lower housing extension. The ball sleeve retains locking keys moveable in radial openings within the lower housing extension that lock against recesses in the upper housing. Axial bores forming internal flow passages of varying diameter extend through the upper housing, ball sleeve, and lower housing, permitting the passage of fluid through the release device.

In the event the bottom hole assembly gets stuck during drilling operations, the ball-drop release device may be actuated to disconnect the tubing from the bottom hole assembly allowing both to be retrieved. To actuate the ball-drop release device, a ball is dropped into the well from the surface and pumped with the drilling fluid through the tubing and through the release device upper housing into the extension to engage and seat with the upper end of the ball sleeve. The ball is preferably hollow and engineered to have a density approximately equal to the density of the drilling fluid such that it has zero buoyancy in the drilling fluid and can therefore be pumped into seated connection with the ball sleeve even when the well bore is lateral or upwardly sloped. Once the ball engages and seats on the ball sleeve, the internal flow passage through the ball sleeve is closed and pressure builds behind the ball sleeve as drilling fluid is pumped into the well. As pressure continues to build, an increasing force is exerted against the shear screws until the force is sufficient to shear them. During this operation, the machined splines on the lower housing extension coupled with the corresponding grooves in the upper housing recess act toresist drilling motor backup torque and prevent the release mechanism from locking up regardless of the proximity of the drilling motor relative to the release device.

Once the shear screws are sheared, the drilling fluid pressure against the ball sleeve moves the ball and ball sleeve into an enlarged internal recess in the lower housing. The ball sleeve is then positioned upstream of a reduced diameter internal passage in the lower housing that leads into the bottom hole assembly. The preferred embodiment of the present invention features elongate recirculation ports at the lower end of the ball sleeve and thus provides an open circulation path for continued flow through the tubing after the release device is activated. The flow moves through the upper housing, through the lower housing, into the enlarged internal recess, and through the ball sleeve recirculation ports into the bottom hole assembly.

Once the release device has been actuated, the upper housing may be separated from the lower housing to retrieve the tubing from the well. As the upper housing and tubing are retrieved, the shear screw section between the upper and lower housings is sheared and the locking keys fall into the release device, since the ball sleeve no longer retains them within the radial openings in the lower housing extension. With the tubing out of the way, fishing operations for the lower housing and bottom hole assembly can commence. A fishing tool having a mill and grapple is lowered into the well to receive and attach to an exposed fishing neck portion of the lower housing extension. Adequate clearance must be provided for the fishing tool to grapple the fishing neck portion and retrieve the lower housing and bottom hole assembly if necessary. Once the fishing tool is attached to the lower housing extension, flow can be resumed through the fishing tool, into the lower housing extension, through the ball sleeve recirculation ports and into the bottom hole assembly to aid in retrieval.

Thus, the present invention comprises a combination of features and advantages that enable it to overcome various problems of prior devices. The characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENT

The present invention relates to a release device and method for disconnecting tubular members downhole. The release device is typically actuated in the event the bottom hole assembly becomes stuck during drilling operations, but may also be actuated for other purposes at the option of the operator. The present invention is susceptible to embodiments of different forms. The drawings described in detail herein illustrate a specific embodiment of the present invention, however the disclosure should be understood to exemplify the principles of the present invention and not limit the invention to the embodiment illustrated and described herein.

Figure 1:
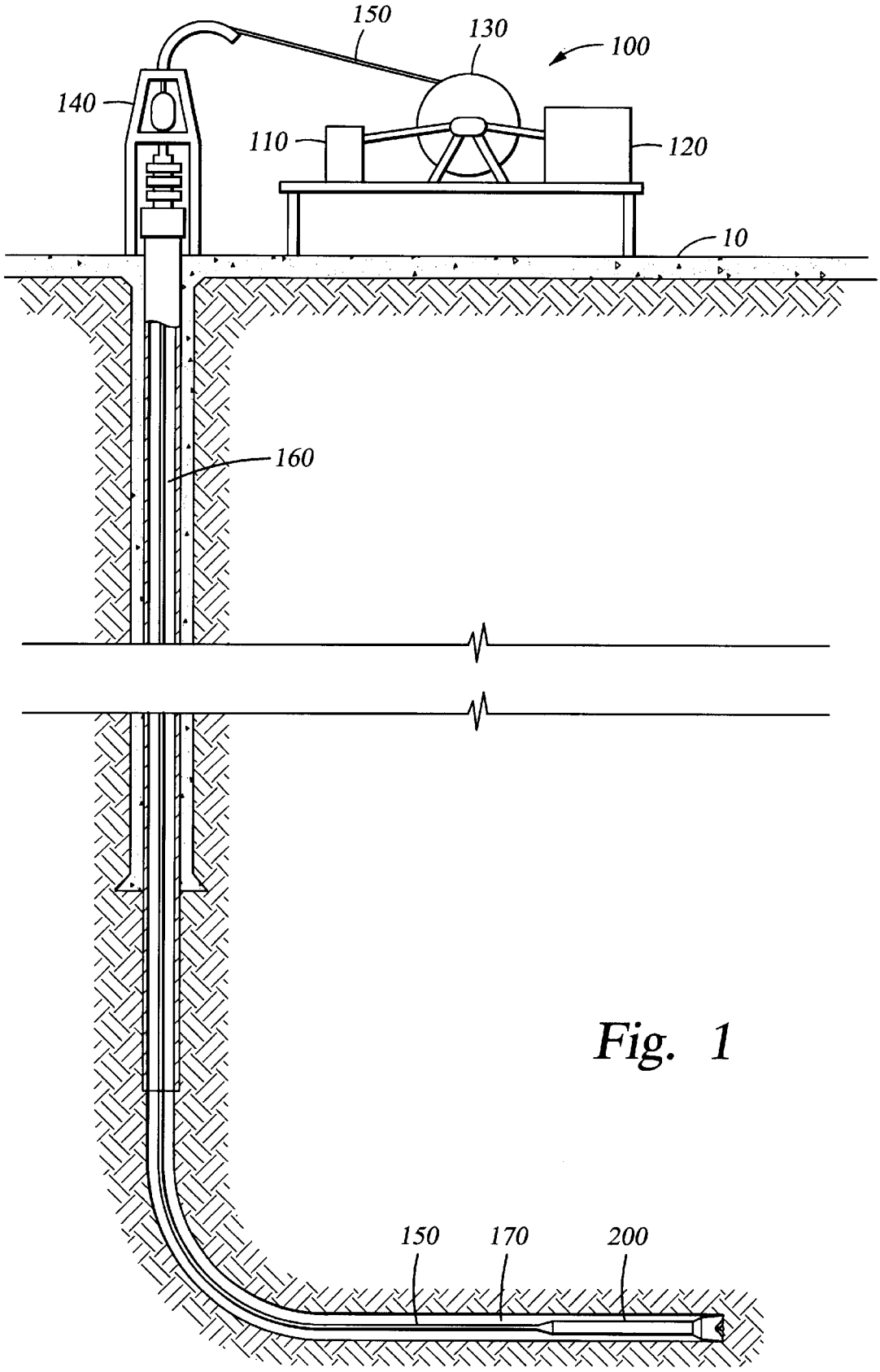
FIG. 1 is a schematic view of a lateral well drilling operation using a drilling apparatus in which the present invention may be installed.

Referring initially to FIG. 1, a well drilling operation in which the present invention may be used includes a coiled tubing system 100 and a bottom hole assembly 200. Coiled tubing system 100 includes a power supply 110, a surface processor 120, and a coiled tubing spool 130. An injector head unit 140 feeds and directs coiled tubing 150 from the spool 130 into the well 160. Although the coiled tubing 150 is preferably composite coiled tubing, it should be appreciated that the present invention is not limited to use with composite coiled tubing and may be used with steel coiled tubing or with standard drill pipe. Bottom hole drilling assembly 200 is shown attached to the lower end of composite coiled tubing 150 and extending into a lateral or horizontal borehole 170. This embodiment is described for explanatory purposes and the present invention is not limited to use in the particular system disclosed, it being appreciated that the present invention may be used to disconnect tubular members downhole in various well plans.

Figure 2:
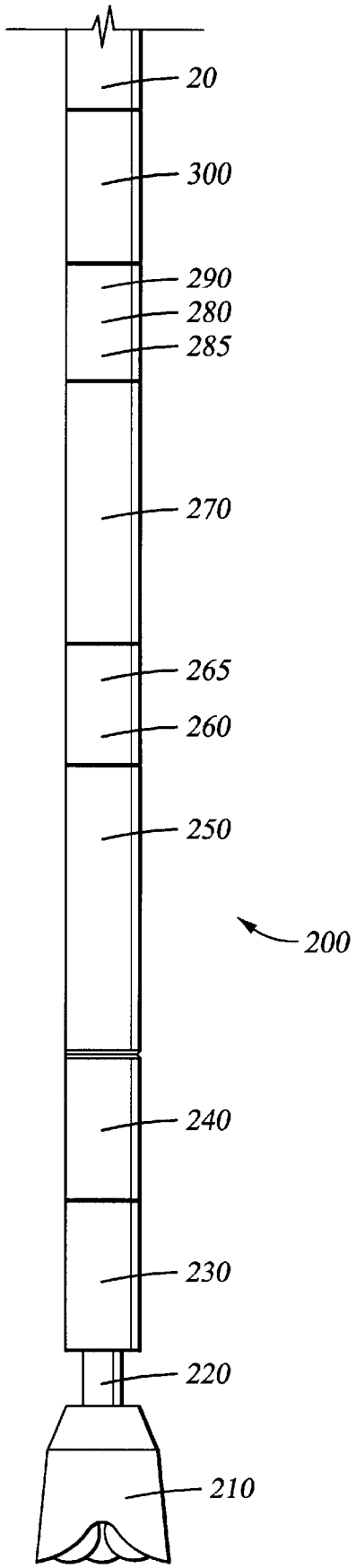
FIG. 2 is an enlarged view of the bottom hole assembly shown in FIG. 1 with the ball-drop release device of the present invention located near the top of the assembly.

Referring now to FIG. 2, bottom hole assembly 200, preferably includes a drill bit 210 at the lower end mounted on a drive shaft 220, which is connected to a bearing pack 230, which is in turn connected to a sliding tool 240. Sliding tool 240 is connected to a steering assembly 250 and a drilling tractor 270. Steering assembly 250 preferably includes an electronic section 260 having a near bit orientation sensor 265 with an inclinometer and magnetometer. Bottom hole assembly 200 may also include an orientation package 280, as well as other sensors 290 and downhole control devices 285 such as those known in the art.

Ball-drop release device 300 is connected between bottom hole assembly 200 and work string 20 that extends to the surface 10 of well 160. The bottom hole assembly 200 and ball-drop release device 300 may be used with any type of work string 20 such as steel coiled tubing, composite coiled tubing 150, or drill pipe. It should be appreciated that the bottom hole assembly 200 may include other components and the order of the components may vary. The tools making up the bottom hole assembly 200 will vary depending on the drilling system being used and the bore hole being drilled. It should be appreciated that the present invention is not limited to use with a particular bottom hole assembly and may be used in conjunction with alternative assemblies.

Figure 3:
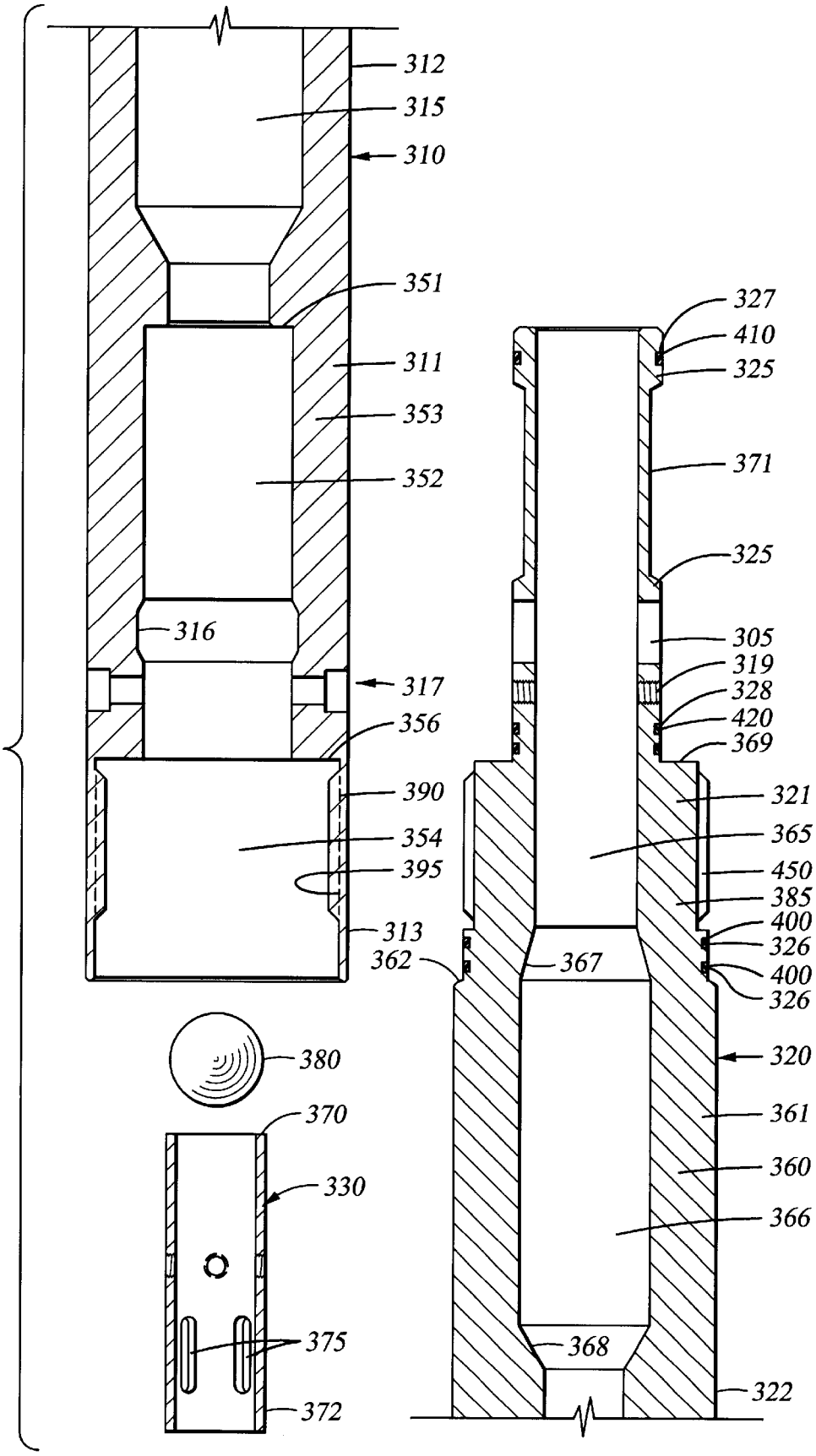
FIG. 3 is a cross-sectional view of a preferred embodiment of the present ball-drop release device with its major components in a disconnected position.

Referring now to FIG. 3, a preferred embodiment of the present ball-drop release device comprises an upper housing 310, a lower housing 320, and a ball sleeve 330. Upper housing 310 comprises a generally cylindrical body 311 having an upper end 312, lower end 313, and an axial bore 315 therethrough. An annular shoulder 351 at a point somewhat below upper end 312 defines a central bore portion 352, and a thin-walled portion adjacent to lower end 313 defines a lower bore 354 having a larger diameter than central bore portion 352. The change in diameter between central bore portion 352 and lower bore 354 defines a shoulder 356 at the upper end of lower bore 354. The wall 353 of central bore portion 352 includes at least one and preferably a plurality of locking key recesses 316. In addition, at least one, and preferably at least two, set screw bores 317 extend radially through wall 353. The wall 390 of lower bore 354 preferably includes a plurality of internal parallel grooves 395 extending along its length between shoulder 356 and end 313.

Lower housing 320 includes a generally cylindrical body 360 having an upper end 321, a lower end 322, and an axial bore 365 therethrough. Body 360 includes an increased-diameter portion 361 and a middle portion 385 that define an annular shoulder 362 about the outside of body 360. A series of parallel machined splines 450 are preferably disposed along the outside of middle portion 385 and a pair of pressure sealing o-ring grooves 326 is preferably located on the outside of middle portion 385 just above shoulder 362. Within body 360, an increased-diameter portion of bore 365 forms an internal recess 366 defined by upper and lower frustoconical shoulders 367, 368 respectively.

A reduced-diameter extension 325 extends coaxially from upper end 321 and extends bore 365. The outside diameter of extension 325 corresponds to the inside diameter of central bore portion 352 of upper housing 310, while the outside diameter of middle portion 385 corresponds to the inside diameter of lower bore 354. Splines 450 disposed along the outer wall of middle portion 385 correspond to and are designed to fit within internal grooves 395 of wall 390. The difference in diameters between middle portion 385 and extension 325 defines an annular shoulder 369 at the upper end 321 of middle portion 385. Extension 325 includes a pair of pressure sealing o-ring grooves 328 just above shoulder 369 and another packing o-ring groove 327 near its upper end. Between o-ring groove 327 and o-ring grooves 328, extension 325 includes a reduced-diameter portion defining a fishing neck 371. Between fishing neck 371 and o-ring grooves 328, extension 325 includes at least one locking key opening 305 and at least one set screw bore 319. The number and position(s) of locking key opening(s) 305 preferably corresponds to the number and position of locking key recess(es) 316, and the number and position(s) of set screw bore(s) 319 preferably corresponds to the number and position of set screw bores 317.

Still referring to FIG. 3, ball sleeve 330 is preferably a relatively thin-walled cylinder having an upper end 370 and a lower end 372. According to a preferred embodiment, a plurality of longitudinal recirculation ports 375 comprise elongate openings in the cylinder wall adjacent to lower end 372.

Figure 4A:
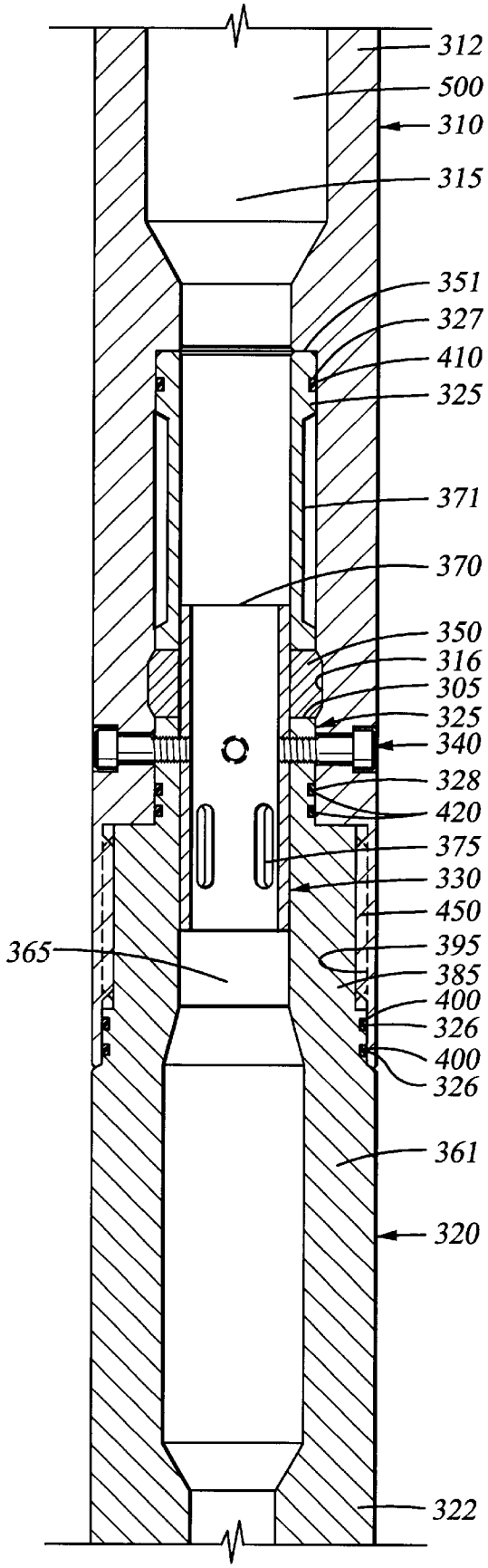
FIG. 4A is a cross-sectional view of the ball-drop release device of FIG. 3, with its components disposed in a connected and locked pre-release position during normal drilling operations.

FIG. 4A shows the ball-drop release device assembled and locked in the pre-release position, as it would appear during normal drilling operations. Extension 325 fits within female recess 352 of upper housing 310 and is retained therein by locking keys 350, which are disposed in opening 305. Locking keys 350 are longer than the thickness of the extension wall so that they extend outward therefrom and engage recesses 316 in upper housing 310. Keys 350 are preferably formed of metallic material and chamfered along the top and bottom edges. When the assembly is in its pre-release position as shown, ball sleeve 330 retains keys 350 and thus prevents upper housing 310 from disengaging from lower housing 320. O-ring pressure seals 400 and 420 seal the interface between upper housing 310 and lower housing 320 at a plurality of locations. Specifically, seals 400 are disposed in seal grooves 326 and seals 420 are disposed within seal grooves 328. Packing seal 410 is disposed in packing groove 327 near the upper edge of extension 325 where it engages shoulder 351, and seal 410 prevents sand from packing between extension 325 and central bore portion 352, thereby eliminating potential problems separating upper housing 310 from lower housing 320.

Still referring to FIG. 4A, machined splines 450 correspond with and fit into grooves 395 as lower housing 320 and upper housing 310 engage. This splined connection prevents the lower housing 320 from rotating with respect to the upper housing 310 during drilling operations in response to drilling motor backup torque, i.e. the splined connection resists drilling motor backup torque. Splines 450 are parallel keys formed to extend from the wall of housing 320 and thereby do not weaken the lower housing 320 construction as would a connection means requiring that slots be cut into middle portion 385. Splines 450 may be straight-sided but preferably are involute because involute splines have greater torque-transmitting capability and have a self-centering action under load such as backup torque from a mating bottom-hole assembly motor.

Ball sleeve 330 is disposed within extension 325 and is locked in place relative to the upper and lower housings 310, 320 by shear screws 340 extending radially through the set screw bores 317, 319. As shown, axial bores 315, 365 align longitudinally to form flow passage 500 extending from the upper end 312 of the upper housing 310 to the lower end 322 of the lower housing 320 that allows drilling fluid to pass through the tool.

Figure 4B:
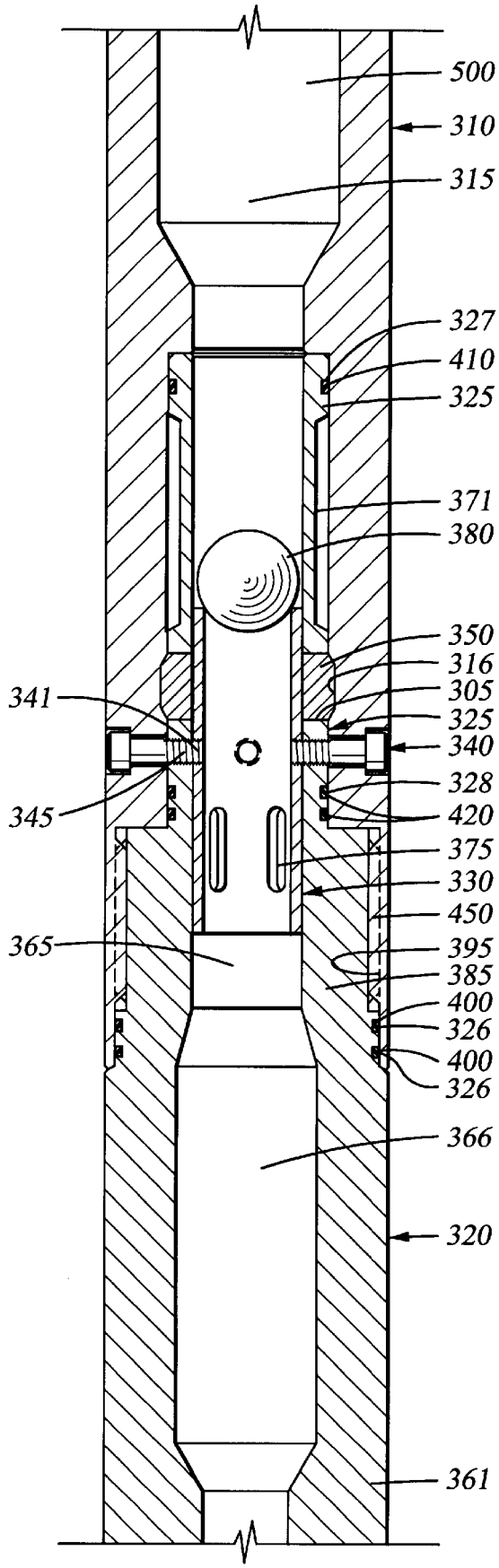
FIG. 4B is a cross-sectional view of the ball-drop release device of FIG. 3 with its components in an actuation position and with the release ball in place.

FIG. 4B shows the ball release device in the actuation position with the release ball 380 in place. Release ball 380 is preferably a hollow metallic ball that is designed to have a density approximately equal to the density of the drilling fluid. When it is desired to release the tubing from the bottom hole assembly 200, ball 380 is dropped into the well from the surface and pumped with the drilling fluid through tubing 150, through upper housing 310 and into engagement with the upper end 370 of ball sleeve 330. Once ball 380 engages and seats on upper end 370, fluid is prevented from passing through the ball sleeve 330. Fluid pressure builds behind ball sleeve 330, creating an increasing force applied against shear screws 340 until they shear, thereby allowing ball 380 and ball sleeve 330 to move into enlarged internal recess area 366 in lower housing 320. Shear screws 340 shear only along lower portion 341, leaving upper portion 345 in place between the upper and lower housings, 310, 320. When ball sleeve 330 moves out of its pre-release position, the locking keys 350 are no longer retained and may drop by force of gravity through openings 305 into the release device, however, locking keys 350 will typically remain in openings 305 until the upper housing 310 is separated from the lower housing 320.

Figure 4C:
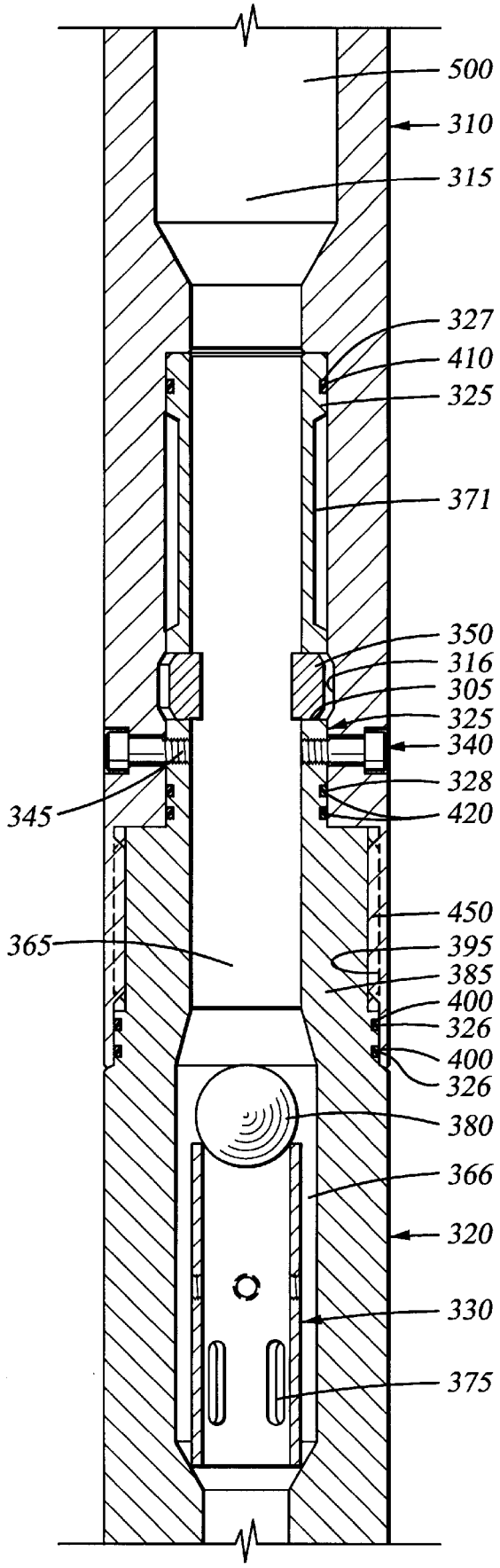
FIG. 4C is a cross-sectional view of the ball-drop release device of FIG. 3 with its components in the released position.

FIG. 4C shows ball 380 and ball sleeve 330 in the released position. From this position, upper housing 310 may be separated from lower housing 320 to disconnect the coiled tubing 150 from the bottom hole assembly 200. Even before separation of the upper and lower housings 310, 320, drilling fluid may continue to flow into the well through the upper housing 310, lower housing 320, internal recess 366, and through recirculation ports 375 into the passage that leads into the bottom hole assembly 200. To actually disconnect the tubing 150 from the bottom hole assembly 200, upper housing 310 and tubing 150 are removed from the hole, thereby shearing outer portions 345 of shear screws 340 and dropping keys 350 out of recesses 305 into the release device. Once the upper housing 310 and tubing 150 are removed, a conventional fishing tool is sent down from the surface to grapple and receive fishing neck 371. This allows lower housing 320 and the bottom hole assembly 200 to which it is connected to be pulled from the hole. Retrieval can be aided by resuming flow into the fishing tool, through recirculation ports 375 into the passage leading to bottom hole assembly 200. Retrieval can be aided by resuming flow into the fishing tool, through recirculation ports 360 into the passage leading to bottom hole assembly 200.

Thus, it can be seen that the device of the present invention provides a reliable and efficient means for releasing tubing from a bottom hole drilling assembly at the option of the operator regardless of whether the bore hole is disposed vertically, laterally, or sloped upwardly. The hollow release ball having a density equal to the drilling fluid can be pumped with the drilling fluid to engage and seat on the ball sleeve in any position to actuate the release device. Therefore, the present invention is particularly useful for disconnecting tubular members in lateral or upwardly sloping sections of a well where the release ball must climb up a chamfer in a reduced diameter section to reach the ball sleeve.

The device of the present invention further provides a reliable and efficient means for releasing tubing from a bottom hole drilling assembly regardless of the proximity of the device relative to the drilling tractor. The involute splines on the lower housing disposed within grooves in the upper housing resist backup torque from the drilling motor thereby preventing the release device from locking up. This feature makes the device of the present invention particularly useful when the drilling tractor is positioned at the top of the bottom hole assembly right below the release device.

The device of the present invention further allows for continued drilling mud circulation after the release mechanism has been actuated. The longitudinal ports disposed around the lower end of the ball sleeve provide a path for drilling fluids to flow into the bottom hole assembly after the ball sleeve moves into the lower housing internal recess to make the upper and lower housings separable. Further, once the upper housing and tubing are removed from the well and a fishing tool grapples the lower housing, flow can be resumed through the fishing tool, through the recirculation ports and into the bottom hole assembly to aid in retrieval.

While preferred embodiments of this invention have been shown and described, modifications thereof can be made by one skilled in the art without departing from the spirit or teaching of this invention. In particular, various embodiments of the present invention provide a number of different constructions that function in the same manner, each of which may be used to disconnect tubular members downhole regardless of whether the bore hole is disposed vertically, laterally, or sloped at an upward angle. The embodiments described herein are exemplary only and are not limiting. Many variations of the system in which the device is used are also possible and within the scope of the invention. Namely, the present invention may be used in conjunction with any type of tubing and any type of bottom hole assembly such that the particular configuration of tubing and bottom hole assembly illustrated and described herein is meant merely to illustrate the function of the present invention as a disconnect device. Accordingly, the scope of protection is not limited to the embodiments described herein, but only by the claims that follow, the scope of which shall include all equivalents of the subject matter of the claims. Where steps in a method are numbered or lettered sequentially, there is no requirement that the method steps be performed in the particular sequence listed unless otherwise stated.

What is claimed is:

1. A device for releasably connecting one tubular member to another tubular member, comprising:

a tubular housing having an upper housing part and a lower housing part, said housing having a housing bore therethrough for the passage of fluid;

a retainer slidably disposed within said lower housing part, said retainer having a sealable retainer bore therethrough for the passage of fluid;

first connectors releasably affixing said upper housing to said lower housing, and second connectors releasably maintaining said retainer in a first position in which said retainer prevents the release of said first connectors;

wherein said retainer, upon the sealing of said retainer bore to block the passage of fluid therethrough, and in response to the resulting pressure of the fluid on said retainer, moves from said first position to a second position, in which said retainer does not prevent the release of said first connectors.

2. The device of claim 1 further including a sphere that is movable with the fluid to engage said retainer.

3. The device of claim 1 wherein said retainer includes a plurality of ports therethrough.

4. The device of claim 3 wherein said ports are elongate and disposed longitudinally about the circumference of one end of said retainer.

5. The device of claim 1 wherein said lower housing includes a member adapted to engage a fishing tool.

6. The device of claim 1 wherein said upper housing sealingly engages said lower housing.

7. The device of claim 1 wherein a seal prevents sand from becoming entrapped between said upper housing and said lower housing.

8. The device of claim 1 wherein said second position is located within an enlarged internal recess in said lower housing.

9. The device of claim 1 wherein said first connectors are locking keys disposed within openings in said upper and lower housing parts.

10. The device of claim 1 wherein said second connectors are shear screws.

11. A device for releasably connecting one tubular member to another tubular member, comprising:

a tubular housing having an upper housing part and a lower housing part, said housing having a housing bore therethrough for the passage of fluid;

a retainer slidably disposed within said housing bore, said retainer having a sealable retainer bore therethrough for the passage of fluid;

first connectors releasably affixing said upper housing to said lower housing, and second connectors releasably maintaining said retainer in a first position in which said retainer prevents the release of said first connectors;

wherein said retainer, upon the sealing of said retainer bore to block the passage of fluid therethrough, and in response to the resulting pressure of the fluid on said retainer, moves from said first position to a second position, in which said retainer does not prevent the release of said first connectors; further including a sphere that is movable with the fluid to engage said retainer; and wherein said sphere has a density approximately equal to the density of the fluid.

12. A device for releasably connecting one tubular member to another tubular member, comprising:

a tubular housing having an upper housing part and a lower housing part, said housing having a housing bore therethrough for the passage of fluid;

a retainer slidably disposed within said housing bore, said retainer having a sealable retainer bore therethrough for the passage of fluid;

first connectors releasably affixing said upper housing to said lower housing, and second connectors releasably maintaining said retainer in a first position in which said retainer prevents the release of said first connectors;

wherein said retainer, upon the sealing of said retainer bore to block the passage of fluid therethrough, and in response to the resulting pressure of the fluid on said retainer, moves from said first position to a second position, in which said retainer does not prevent the release of said first connectors; and wherein said lower housing includes an upper extension and said upper housing includes a recessed end that receives said upper extension.

13. The device of claim 12 wherein said recessed end includes internal grooves and said upper extension includes external splines corresponding to said grooves.

14. A method for using fluid pressure to disconnect two tubular members downhole, comprising the steps of:

(a) providing a tubular housing having upper and lower housing parts releasably connected together and having a path for fluid flow therethrough;

(b) connecting the upper housing to the lower housing with at least one releasable connector;

(c) providing within said lower housing part a shiftable retainer having a sealable bore therethrough;

(d) maintaining the retainer in a first position in which the retainer prevents release of the releasable connector; and (e) pumping a flow obstructer into engagement with the shiftable retainer such that the obstructer prevents the flow of fluid through the sealable bore and allows fluid pressure to build behind the retainer until it is sufficient to shift the shiftable retainer into a second position in which the retainer does not prevent the release of the releasable connector.

15. The method of claim 14 further including the step of flowing fluid through ports in the retainer when the retainer is in said second position.

16. The method of claim 14 further including the step of separating the upper housing from the lower housing and retrieving the upper housing.

17. The method of claim 16 wherein retrieving the upper housing exposes a lower housing end adapted for attaching a fishing tool.

18. The method of claim 16 further including the step of resuming flow through the lower housing after retrieving the upper housing.

19. The method of claim 14 wherein said step (b) comprises providing at least one shearable member that engages the tubular housing and the retainer.

20. The method of claim 14 wherein step (d) comprises providing locking keys disposed within openings in the upper and lower housings.

21. A method for using fluid pressure to disconnect two tubular members downhole, comprising the steps of:

(a) providing a tubular housing having upper and lower housing parts releasably connected together and having a path for fluid flow therethrough;

(b) connecting the upper housing to the lower housing with at least one releasable connector;

(c) providing within said tubular housing a shiftable retainer having a sealable bore therethrough;

(d) maintaining the retainer in a first position in which the retainer prevents release of the releasable connector; and (e) pumping a flow obstructer into engagement with the shiftable retainer such that the obstructer prevents the flow of fluid through the sealable bore and allows fluid pressure to build behind the retainer until it is sufficient to shift the shiftable retainer into a second position in which the retainer does not prevent the release of the releasable connector;

wherein said flow obstructer has a density approximately equal to the density of the fluid.

22. A method for using fluid pressure to disconnect two tubular members downhole, comprising the steps of:

(a) providing a tubular housing having upper and lower housing parts releasably connected together and having a path for fluid flow therethrough;

(b) connecting the upper housing to the lower housing with at least one releasable connector;

(c) providing within said tubular housing a shiftable retainer having a sealable bore therethrough;

(d) maintaining the retainer in a first position in which the retainer prevents release of the releasable connector; and (e) pumping a flow obstructer into engagement with the shiftable retainer such that the obstructer prevents the flow of fluid through the sealable bore and allows fluid pressure to build behind the retainer until it is sufficient to shift the shiftable retainer into a second position in which the retainer does not prevent the release of the releasable connector;

wherein step (a) comprises fitting an extension end of the lower housing into a recess end in the upper housing.

23. The method of claim 22 further including the step of fitting external splines on the extension end into corresponding internal grooves in the recess end.

24. A device for releasably connecting one tubular member to another tubular member, comprising:

a tubular housing having an upper housing part and a lower housing part, said housing having a bore therethrough for the passage of fluid;

a means for connecting said upper housing to said lower housing and preventing relative rotation between said upper and lower housing parts;

a retainer slidably disposed within said housing, said retainer having a sealable retainer bore therethrough;

first connectors for releasably connecting said upper housing to said lower housing;

second connectors for releasably maintaining said retainer in a first position in which said retainer prevents the release of said first connectors;

an obstructer capable of moving with the fluid to engage said retainer so as to prevent the flow of fluid through said retainer bore;

wherein said retainer, upon the sealing of said retainer bore to block the passage of fluid therethrough, and in response to the pressure of the fluid on said retainer, moves from said first position to a second position in which said retainer does not prevent the release of said first connectors, whereupon said upper housing becomes separable from said lower housing;

said obstructer having a density approximately equal to the density of the drilling fluid;

said retainer including a plurality of ports for circulating fluid therethrough when the retainer is in said second position; and said lower housing including an end adapted for engaging a fishing tool.

25. A device for releasably connecting one tubular member to another tubular member, comprising:

a tubular housing having an upper housing part and a lower housing part, said housing having a housing bore therethrough for the passage of fluid;

a retainer slidably disposed within said lower housing part, said retainer having a sealable retainer bore therethrough for the passage of fluid;

first connectors releasably affixing said upper housing to said lower housing, and second connectors releasably maintaining said retainer in a first position in which said retainer prevents the release of said first connectors;

wherein said retainer, upon the sealing of said retainer bore to block the passage of fluid therethrough, and in response to the resulting pressure of the fluid on said retainer, moves from said first position to a second position, in which said retainer does not prevent the release of said first connectors; and wherein said retainer is ported such that fluid flow through the retainer is possible when said retainer is in said second position, even if said retainer bore remains sealed.

* * * * *

UNITED STATES PATENT AND TRADEMARK OFFICE

CERTIFICATE OF CORRECTION

PATENT NO. : 6,318,470 B1
DATED : November 20, 2001
INVENTOR(S) : Chi-Huang Michael Chang, James W. Estep, Albert C. Odell, II It is certified that error appears in the above-identified patent and that said Letters Patent is hereby corrected as shown below:

Column 2,
Item [74] Attorney, Agent, or Firm - change {Godley], Rose & Tayon, P.C. to
-- Conley --

Signed and Sealed this

Nineteenth Day of March, 2002

*Attest:*

*Attesting Officer*

JAMES E. ROGAN
*Director of the United States Patent and Trademark Office*